United States Patent [19]

Connor et al.

[11] Patent Number: 5,010,673

[45] Date of Patent: Apr. 30, 1991

[54] PLASTIC CARD HOLDER

[75] Inventors: John K. Connor; Charles M. Connor, Jr.; H. B. Stroup, Jr., all of Asheville, N.C.

[73] Assignee: Collectors Products Corporation, Asheville, N.C.

[21] Appl. No.: 376,816

[22] Filed: Jul. 7, 1989

[51] Int. Cl.[5] ..... G09F 3/18

[52] U.S. Cl. ..... 40/661; 40/152.1; 220/307; 248/455

[58] Field of Search ..... 40/661, 323, 156, 159.2, 40/642, 152, 159, 152.1; 206/39, 232, 449; 220/307, 352, 339; 248/455

[56] References Cited

U.S. PATENT DOCUMENTS

| | | | |
|---|---|---|---|
| 847,052 | 3/1907 | Englefield | 248/455 |
| 3,029,548 | 4/1962 | Braha | 248/455 |
| 3,281,976 | 11/1966 | Riedel | 40/152 |
| 3,581,422 | 6/1971 | Kondo | 40/152 |
| 3,808,722 | 5/1974 | Byers et al. | 40/152 |
| 3,949,505 | 4/1976 | Kato | 40/152 |
| 4,443,959 | 4/1984 | Acker et al. | 40/152 |
| 4,524,867 | 6/1985 | Klein et al. | 206/232 |
| 4,703,853 | 11/1987 | Byrns | 220/339 |
| 4,745,695 | 5/1988 | Hetzer | 40/661 |
| 4,829,691 | 5/1989 | Manjos et al. | 40/661 |
| 4,869,364 | 9/1989 | Bray | 206/232 |

FOREIGN PATENT DOCUMENTS

| | | | |
|---|---|---|---|
| 608653 | 9/1960 | Italy | 248/455 |
| 2092329 | 8/1982 | United Kingdom | 40/159.2 |

*Primary Examiner*—Kenneth J. Dorner
*Assistant Examiner*—Brian K. Green
*Attorney, Agent, or Firm*—Ralph H. Dougherty

[57] ABSTRACT

A plastic holder for a display item includes a clear base panel having a top surface and a bottom surface and a top surface area greater than the display item. The top surface has a recessed portion for containing the display item and a plurality of flanges along the periphery of the base panel which extend upwardly from the top surface of the base panel. A clear insert panel also has a top surface and a bottom surface with a bottom surface area greater than the display item, and has notches along the periphery of the insert panel in positions corresponding to the flanges on the top surface of the base panel for mating with the flanges of the base panel. A mechanism for securing the insert panel to the base panel is also provided. An attachable device is provided for standing the holder upright and adjusting the viewing angle.

22 Claims, 7 Drawing Sheets

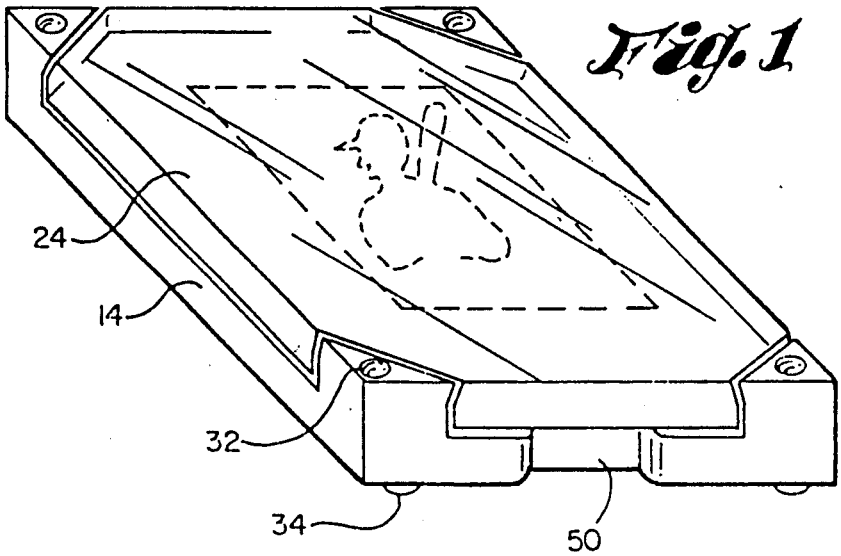
Fig. 1
Fig. 2
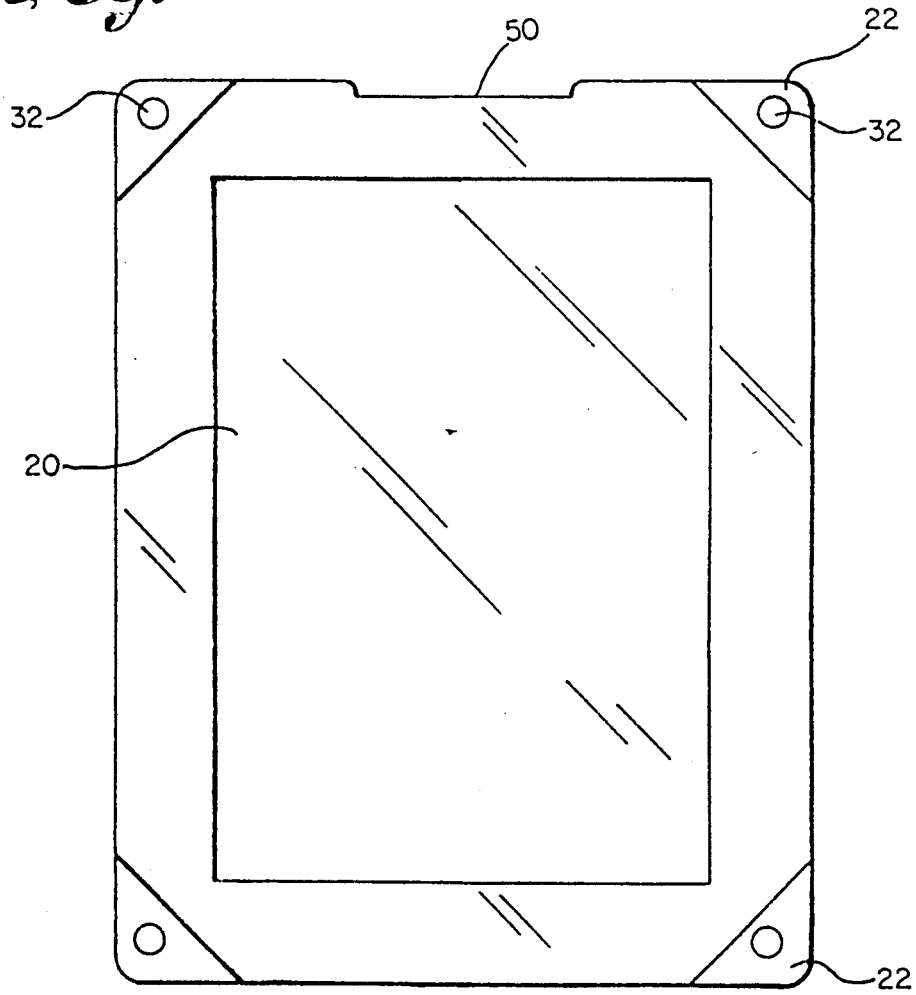

Fig. 9
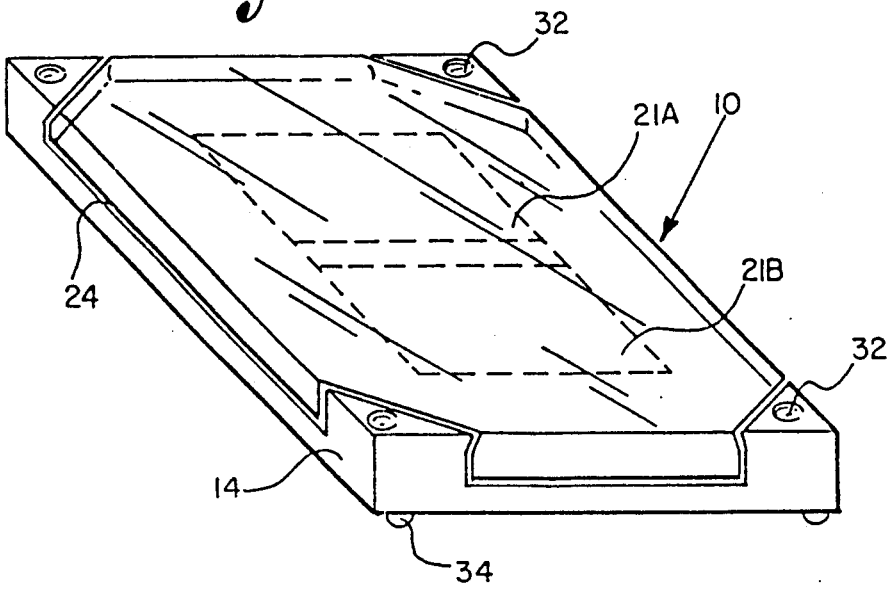
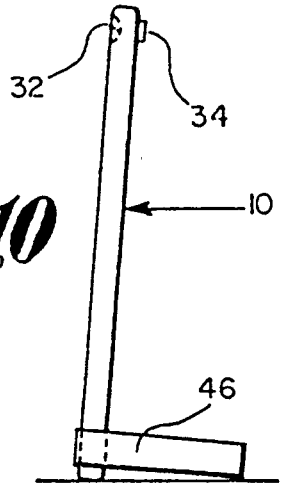
Fig. 10
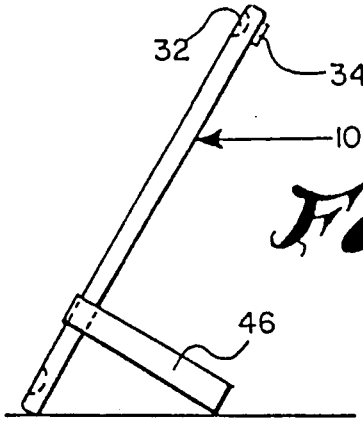
Fig. 12
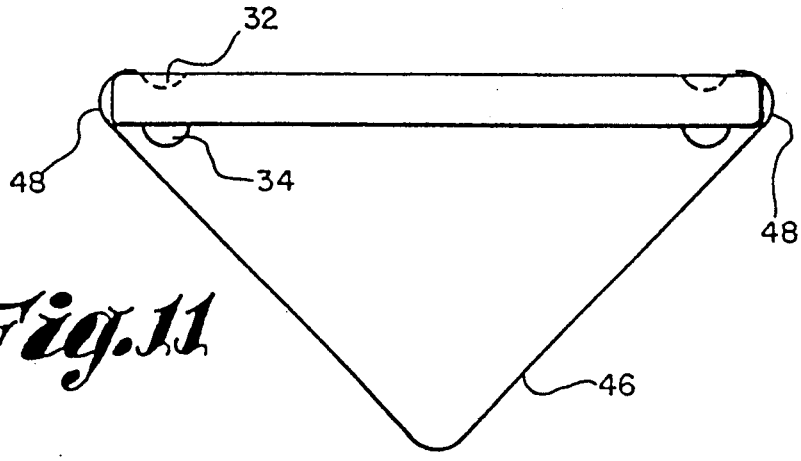
Fig. 11

PLASTIC CARD HOLDER

BACKGROUND OF THE INVENTION

1. Field of the Invention

The present invention generally relates to display devices and, more particularly, is concerned with plastic card holders.

2. Description of the Prior Art

Baseball card trading is big business. A single card may, on occasion, be worth thousands of dollars. In addition to their economic value, collectors and dealers will also attach an emotional and sentimental value to cards. Consequently, it is important to protect the cards from damage by exposure to the elements or by periodic handling. Obviously, a well preserved baseball card will be worth more to a collector, both in terms of personal viewing pleasure and in terms of monetary value.

It is also important for both dealers and collectors to be able to handle individual cards for the purpose of displaying, trading and selling them, but without impairing the view of each card. Thus it is advantageous to provide a means by which the external surfaces of the holder are protected from damage, particularly from scratching.

Thus, baseball card collectors and dealers need a product that holds, protects and displays a single baseball card that is quick and simple to use. The plastic card holder is made up of two clear plastic panels that snap firmly together and are easily removable. The invention holds, protects and displays a single card, such as a baseball card. Each holder has a recess and mating protrusion on each corner that allows holders to be stacked on each other for transportation and storage, without scratching or damaging one another. An attachable device is provided for standing the holder upright and adjusting the viewing angle.

Previous and present card holders are made with multiple parts. Card replacement typically requires unscrewing a number of screws from associated nuts, removing the top half, swapping the card, carefully aligning the card, carefully replacing the top without moving the card, and reinstalling and retightening the screws to the nuts. Obviously, this is a time consuming and painstaking process. In addition, some currently used devices use threaded holes for receiving the screws, which greatly increase the cost of the holder. The present invention has a recessed area for the card. Replacing a card is a "snap." Simply lift and unsnap the top, swap the card, and snap the top on by manual pressure. The task can be accomplished in a matter of seconds. The product is marketed under the name "SNAP-IT."

The applicants are aware of the following U.S. Patent concerning card holders.

| U.S. Pat. No. | Issue Date | Inventor | Title |
|---|---|---|---|
| 4,829,691 | May 16, 1989 | Manjos, et al. | CARD DISPLAY HOLDER AND PROTECTOR |

Manjos, et al. teaches a display device and protector suitable for holding a card or card-like object, in which two transparent panels are folded along a common hinge line and the two sides are connected. The Manjos device has more limited life than that of the applicants because the fold line will become weakened and fail.

Manjos also requires more expensive equipment to produce. Still another distinguishing feature of the present invention is the novel means for adjusting the viewing angle of the assembled card holder. No such means is disclosed in Manjos.

SUMMARY OF THE INVENTION

The present invention is an innovative plastic card holder, which overcomes the problems and satisfies the needs considered above.

The invented plastic holder for a card includes a clear base panel having a top surface and a bottom surface and an area greater than the card. The top surface has a recessed portion for containing the card and a plurality of flanges along the periphery of the base panel which extend upwardly from the top surface of the base panel at the corners. A clear insert panel also has a top surface and a bottom surface and an area greater than the card, and has notches along the periphery of the insert panel, in positions corresponding to the flanges on the top surface of the base panel, for mating with the flanges of the base panel. A means for securing the insert panel to the base panel is also provided. Adapter means for standing the holder upright and adjusting the viewing angle is also provided.

In summary, the invention encompasses two clear plastic panels that snap firmly together and are easily separated for insertion of an item in a recess in one panel. The invention holds, protects and displays a single display item such as a baseball card.

OBJECTS OF THE INVENTION

The principal object of the present invention is to provide baseball card collectors and dealers with a product that holds, protects and displays a single baseball card that is quick and simple to use.

It is also an object to provide a holder that allows selective viewing of both front and back of an item.

Another object of the invention is to provide a holder having a positive locking mechanism for securing the display item in the card holder.

Another object of the invention is to provide a holder having means for stacking for transportation and storage without scratching or damaging an adjacent holder.

Another object of the invention is to provide a holder for display of other small items, such as stamps, coins, paper currency, newspaper articles, and pictures.

It is a further object of the invention to provide a means for standing the holder upright and adjusting the viewing angle.

BRIEF DESCRIPTION OF THE DRAWINGS

The foregoing and other objects will become more readily apparent by referring to the following detailed description and the appended drawings in which:

FIG. 1 is an isometric view of the invention in use with a baseball card.

FIG. 2 is a top view of the base panel of the invented card holder.

FIG. 9 is an alternative embodiment of the invention shown in FIG. 1, having a plurality of recesses for receiving display items.

FIG. 10 is a side view of the invention in combination with an adjustable V-shaped support for adjusting the viewing angle of the holder.

FIG. 11 is a plan view of the holder and V-shaped support shown in FIG. 10.

FIG. 12 is a side view of the holder and V-shaped support shown in FIG. 10, showing the holder positioned at an inclined viewing angle.

DESCRIPTION OF THE PREFERRED EMBODIMENTS

Figure 3:
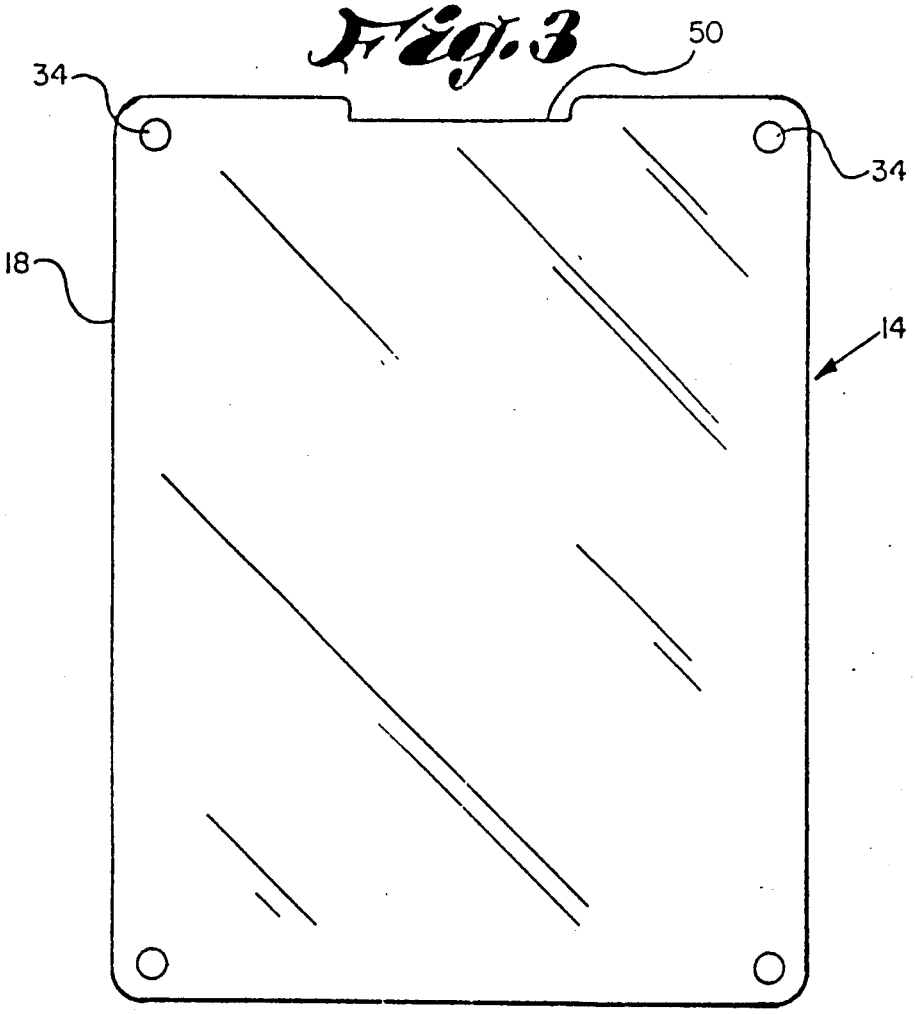
FIG. 3 is a bottom view of the base panel of the card holder.

Referring now to the drawings, and more particularly to FIG. 1, a plastic card holder, generally designated 10, comprises the preferred embodiment of the present invention.

Figure 4:
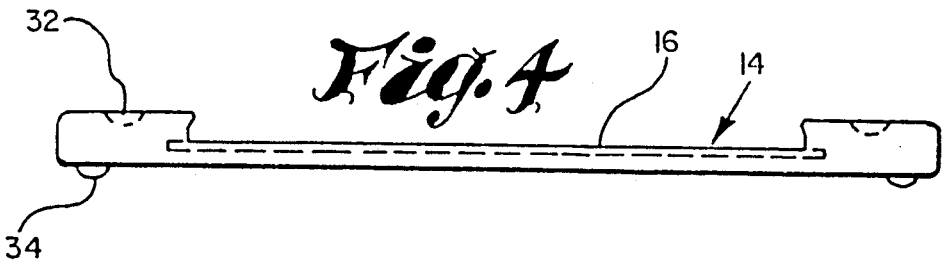
FIG. 4 is a side elevation of the base panel shown in FIGS. 2 and 3.
Figure 5:
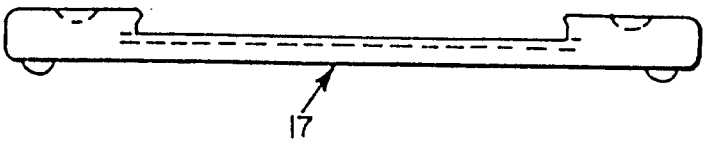
FIG. 5 is an end elevation of the base panel shown in FIGS. 2 and 3.
Figure 6:
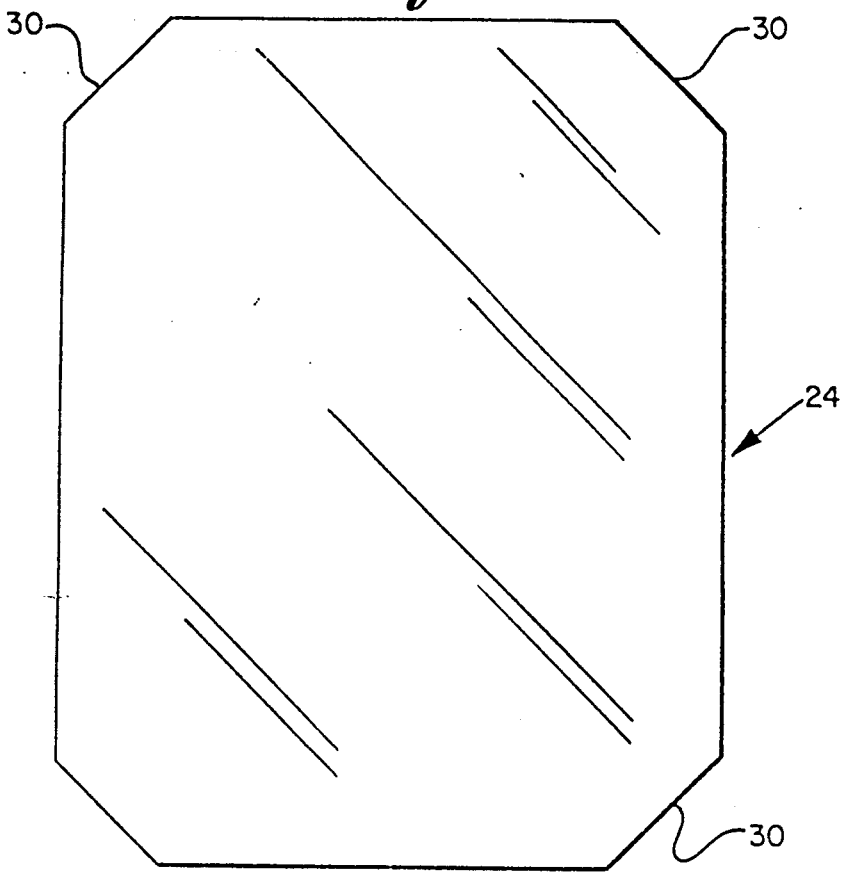
FIG. 6 is a plan view of the insert panel according to the invention.
Figure 7:
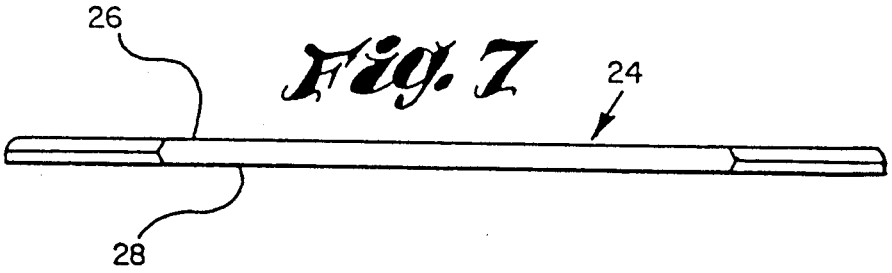
FIG. 7 is a side elevation of the insert panel shown in FIG. 6.
Figure 8:
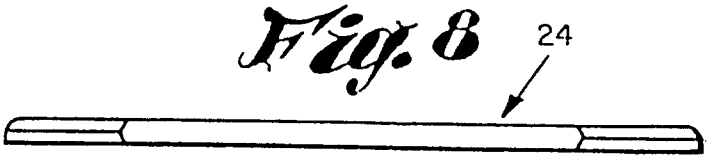
FIG. 8 is an end elevation of the insert panel shown in FIG. 6.
Figure 19:
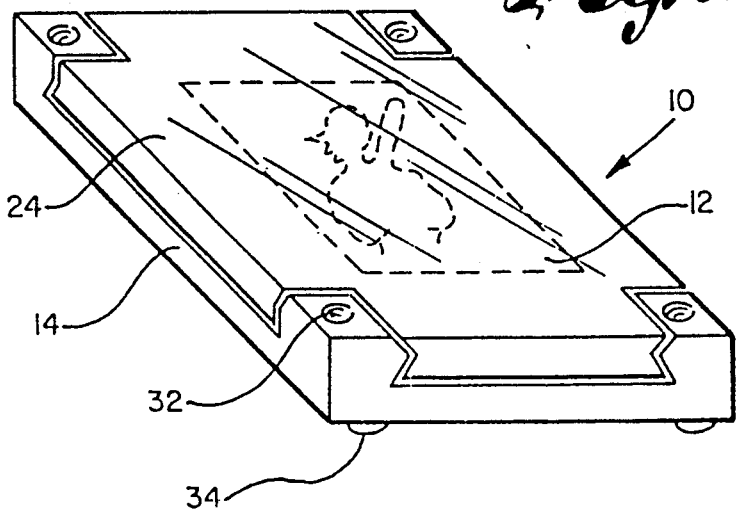
FIG. 19 is an isometric view of an alternative embodiment of the invention in use with a baseball card, showing rectangular shaped flanges.

The plastic holder 10 for receiving a display item 12, includes a clear base panel 14, having a top surface 16, as shown in FIG. 4, and a bottom surface 18, as shown in FIG. 3. The surface area of the base panel 14 is greater than that of the display item 12. The top surface 16 has a recessed portion 20, for containing the display item 12 preferably just slightly larger than and having the configuration of the display item 12. A plurality of flanges 22 along the periphery of the base panel 14, extend upwardly from the top surface 16 of the base panel 14. The base panel 14 is preferably rectangular with the flanges 22 positioned at each corner of the base panel 14. A clear cover or insert panel 24 as shown in FIGS. 6, 7 and 8, also has a top surface 26, a bottom surface 28, and a surface area greater than the display item 12. The insert panel 24 has angled corners or notches 30 around the periphery of the insert panel 24, in positions corresponding to the flanges 22 on the top surface 16 of the base panel 14, for mating with the flanges 22 of the base panel 14. In the preferred embodiment, the flanges 22 are triangular in shape and are positioned at each corner of the base panel 14. The notches 30 are created at each corner of the insert panel 24 by constructing 45° corners, as shown in FIG. 6. The insert panel 24 is secured to the base panel 14 by angling the flanges 22, as shown in FIGS. 4 and 5, for snugly mating the insert panel 24 to the base panel 14. Alternatively, the flanges 22 could use a square shape as opposed to a triangular shape as shown in FIG. 19.

Figure 14:
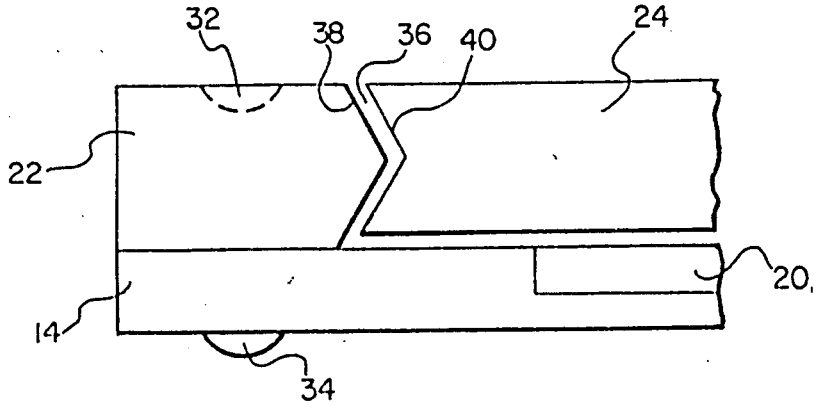
FIG. 14 is an enlarged cross-section of the holder showing an alternative embodiment for securing the base panel to the insert panel, the flange mating means being beveled outwardly and the insert panel mating means being beveled inwardly, both in a V-shaped manner.
Figure 15:
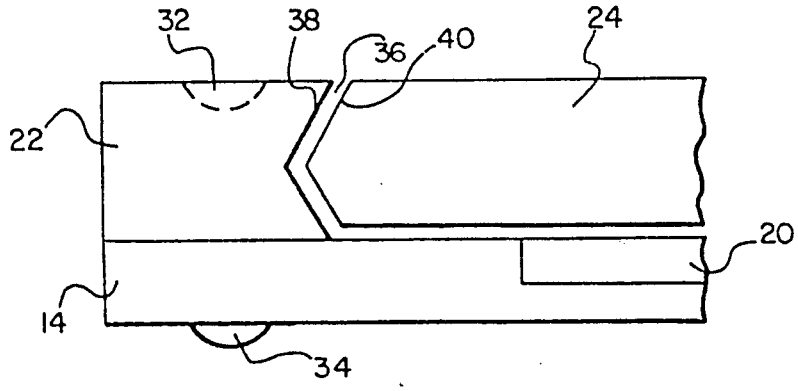
FIG. 15 is an enlarged cross-section of the holder showing an alternative embodiment for securing the base panel to the insert panel, the flange mating means being beveled inwardly and the insert panel mating means being beveled outwardly, both in a V-shaped manner.
Figure 13:
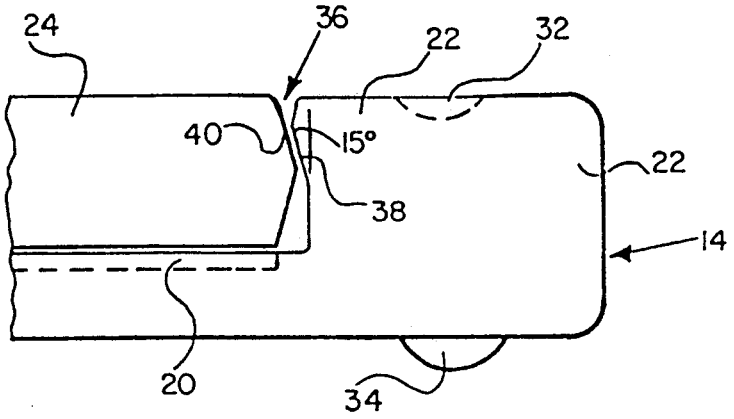
FIG. 13 is an enlarged cross section of a corner portion of the holder, and indicating the preferred means for securing he base panel to the insert panel.
Figure 16:
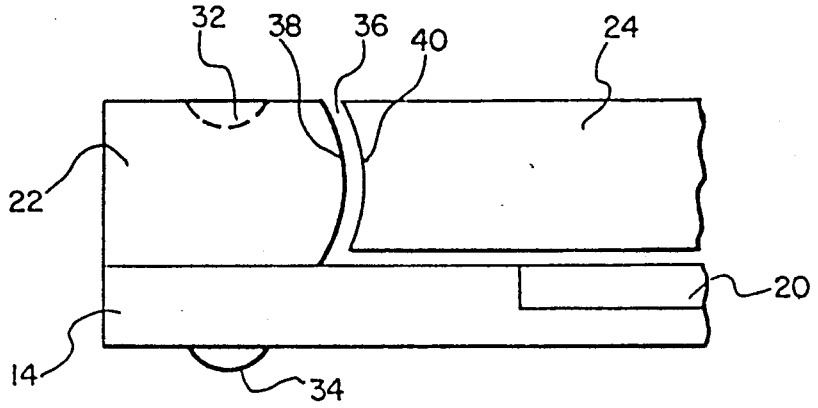
FIG. 16 is an enlarged cross-section of the holder showing an alternative embodiment for securing the base panel to the insert panel, the flange mating means being beveled outwardly and the insert panel mating means being beveled inwardly, both in a rounded manner.
Figure 17:
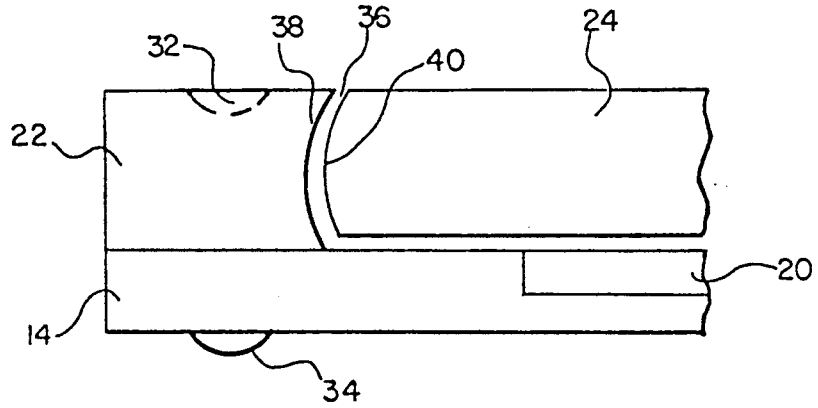
FIG. 17 is an enlarged cross-section of the holder showing an alternative embodiment for securing the base panel to the insert panel, the flange mating means being beveled inwardly and the insert panel mating means being beveled outwardly, both in a rounded manner.
Figure 18:
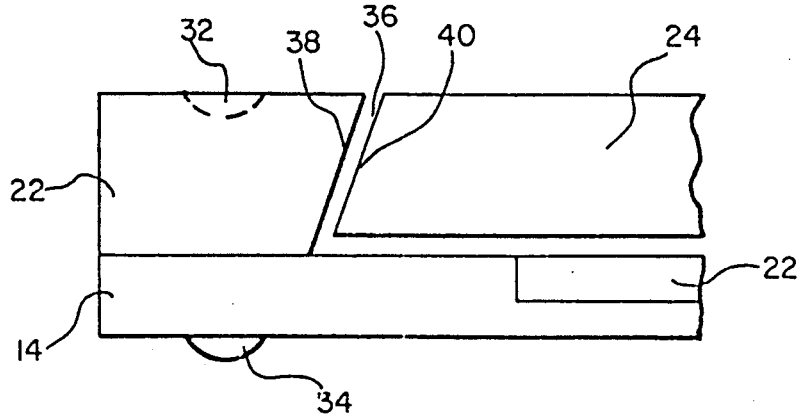
FIG. 18 is an enlarged cross-section of the holder showing an alternative embodiment for securing the base panel to the insert panel, the flange mating means being sloped inwardly from the top of the flange and the insert panel mating means being beveled outwardly from the top of the insert panel.

A connecting means 36 integral with the insert panel 24 and the base panel 14 is provided for securing the insert panel 24 to the base panel 14. A variety of securing configurations are possible, however. In the preferred embodiment shown in FIG. 13, both the flange and the insert panel mating means 38, 40 are outwardly beveled to form V-shaped rims. The mating means 38, 40 are angled in such a manner that when the insert panel 24 is pressed down upon the base panel 14, the V-shaped rim of insert panel 24 snaps into place underneath the V-shaped rim of flanges 22, thereby securing the base panel 14 and the insert panel 24 together. The angle of mating surfaces 38, 40 from the vertical can be any angle sufficient to retain the insert, but preferably is between about 8° to 30° (FIG. 13 shows 15°). FIGS. 14 through 18 illustrate several alternative embodiments for the securing means 36, for example, beveling the flange mating means 38 outwardly and beveling the insert panel mating means 40 inwardly, as shown in FIG. 14. The flange and insert panel mating means 38,40 are also shown with a rounded shape in FIGS. 16 and 17. Still another embodiment is illustrated in FIG. 18, which shows the flange mating means 38 sloping inward from the top of the flange 22 and the insert panel mating means 40 as outwardly beveled from the top of the insert panel 24.

In the preferred embodiment, the base panel 14 and the insert panel 24 are made of clear polystyrene, although other transparent plastics can be used. Also, in the preferred embodiment, the top surface of each flange 22 has an indentation 32. A plurality of protuberances 34 on the bottom surface 18 of the base panel 14, in positions corresponding to the indentations 32 on the top surface 16 of the base panel 14, mate with the indentations 32 of another plastic holder 10. The depth of indentation 32 is less than the height of protuberance, to space stacked holders slightly apart, which prevents scratching of the surfaces through which the display item is viewed. Alternatively, the diameter of the protuberance can be greater than that of the indentation, with the same result. In the preferred embodiment, the recessed portion 20 for containing the display item 12 is adapted for receiving a baseball card. Alternatively, as shown in FIG. 9, a plurality of recesses 21A and 21B are provided for containing display items, the configuration of which varies, the recesses being adapted for receiving any of a variety of collector type items, such as coins, stamps, paper currency, newspaper articles, and pictures. Preferably, a cutout portion 50 is provided on the base panel 14 for gripping the insert panel 24 with a finger, which enables easy removal and replacement of display items.

Figure 20:
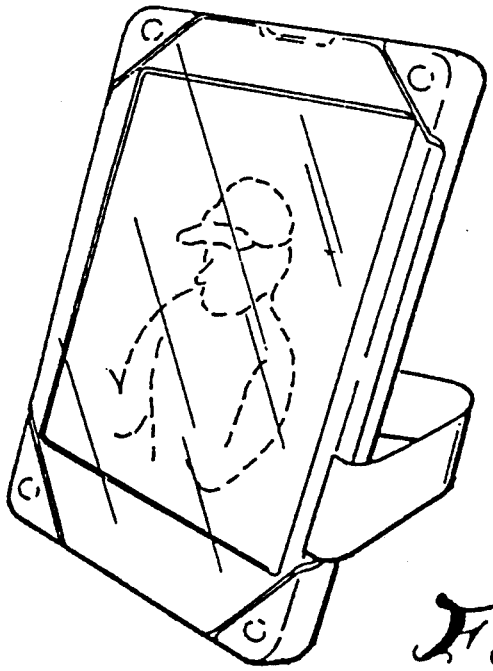
FIG. 20 is an isometric view of an alternative embodiment of the invention in use with the V-shaped support, showing the invention with rounded edges and corners.

The plastic holder 10 may be provided with a detachable support means 46 for positioning the plastic holder 10 in an upright position and adjusting the angle of plastic holder 10 for viewing the display item 12, as shown in FIGS. 10 through 12. Preferably, the support 46 is V-shaped (FIG. 11) having holder-engaging gripping means 48 at each end of the support for attachment to the sides of the plastic holder 10 by clamping thereon. The support 46 is made of flexible steel, or some other flexible, resilient material, such as plastic, with turned-in ends 48 capable of supporting and gripping the plastic holder 10. The width of the V-shaped support 46 is less than the height of the plastic holder 10. The narrower the width of the support 46, the greater the range of the viewing angle. The viewing angle of the display item is adjustable by sliding the support 46 up or down the sides of the plastic holder 10, as seen in FIGS. 12 and 20.

SUMMARY OF THE ACHIEVEMENTS OF THE OBJECTS OF THE INVENTION

From the foregoing, it is readily apparent that we have invented a device for providing baseball card collectors and dealers with a product that holds, protects and displays a single baseball card that is quick and simple to use, providing a positive locking mechanism for securing the card in the card holder, providing a holder that is designed so that each holder has a recess and mating protrusion on each corner that allows holders to be stacked on each other for transportation and storage without scratching or damaging one another, and providing a holder for display of other small items, such as stamps, coins, paper currency, newspaper articles, and pictures.

It is to be understood that the foregoing description and specific embodiments are merely illustrative of the best mode of the invention and the principles thereof, and that various modifications and additions may be made to the device by those skilled in the art, without departing from the spirit and scope of this invention, which is therefore understood to be limited only by the scope of the appended claims.

We claim:

1. A plastic holder for receiving and containing a display item, comprising:

(a) a clear base panel having a top surface and a bottom surface and a surface area greater than that of the display item the top surface having a recess therein for containing the display item and a plurality of flanges along a periphery of the base panel which extend upwardly from the top surface of the base panel;

(b) a separate clear insert panel having a top surface and a flat bottom surface and a surface area greater than that of the display item, and having notches about a periphery of the insert panel in positions corresponding to the flanges on the top surface of the base panel adapted for mating with the flanges of the base panel; and (c) said flanges and said notches providing a means for securing the insert panel to the base panel, wherein each of said flanges is provided with an outwardly protruding V-shaped rim, each of the notches of said insert panel forming a horizontally protruding V-shaped rim, the rim of said insert panel being beneath the rim of said flange when the holder is assembled.

2. The plastic holder according to claim 1, wherein the base panel and the insert panel are clear polystyrene.

3. The plastic holder according to claim 1, wherein the base panel is rectangular and the flanges are positioned at each corner of the base panel.

4. The plastic holder according to claim 3, wherein the base panel has rounded corners.

5. The plastic holder according to claim 1, further comprising the base panel having at least one cutout portion, along the periphery of the base panel, for facilitating the gripping and removal of the insert panel from the base panel.

6. The plastic holder according to claim 1, further comprising each flange having an indentation on a top thereof, and a plurality of protuberances on the bottom surface of the base panel, adapted for mating with a second similarly configured plastic holder.

7. The plastic holder according to claim 1, wherein the recess for containing the display item is adapted for receiving a baseball card.

8. The plastic holder according to claim 1, further comprising a plurality of recesses in the base panel for containing display items.

9. The plastic holder according to claim 8, wherein the plurality of recesses are adapted for receiving coins.

10. The plastic holder according to claim 8, wherein the plurality of recesses are adapted for receiving stamps.

11. The plastic holder according to claim 1, wherein the recess is adapted for receiving paper currency.

12. The plastic holder according to claim 1, wherein the recess is adapted for receiving a newspaper article.

13. The plastic holder according to claim 1, wherein the recess is adapted for receiving a picture.

14. The plastic holder according to claim 1, wherein each flange is provided with an inside surface configuration for mating with a corresponding configuration on the mating surface of the insert panel.

15. The plastic holder according to claim 1, further comprising said plastic holder having sides, wherein said plastic holder is supported by a unitary V-shaped support, made of a resilient material selected from the group consisting of plastic, spring steel, aluminum, hard rubber and wood, having gripping means at each end of the support for attachment to the sides of the plastic holder, the gripping means adapted for slidable positioning at locations along the plastic holder, for varying a viewing angle of the plastic holder.

16. A plastic holder for receiving and containing a display item, comprising:

(a) a generally rectangular clear base panel having a top surface and a bottom surface and a surface area greater than that of the display item, the top surface having a recess therein for containing the display item and a plurality of flanges extending upwardly from the top surface of the base panel at each corner thereof;

(b) a separate clear insert panel having a top surface and a flat bottom surface and a surface area greater than that of the display item, and having notches about a periphery of the insert panel in positions corresponding to the flanges on the top surface of the base panel adapted for mating with the flanges of the base panel; and (c) said flanges and said notches providing a means for securing the insert panel to the base panel, wherein each of said flanges is provided with a recess, each of the notches of said insert panel being provided with a horizontally protruding rim, the rim of said insert panel mating with the recess of said flange when the holder is assembled, said insert panel being adapted for engagement with said base panel by manual pressure.

17. The plastic holder according to claim 16, wherein the base panel has rounded corners.

18. The plastic holder according to claim 16, further comprising the base panel having at least one cutout portion, along the periphery of the base panel, for facilitating the gripping and removal of the insert panel from the base panel.

19. The plastic holder according to claim 16, further comprising each flange having an indentation on a top thereof, and a plurality of protuberances on the bottom surface of the base panel, adapted for mating with a second similarly configured plastic holder.

20. The plastic holder according to claim 16, wherein the recess for containing the display item is adapted for receiving a baseball card.

21. The plastic holder according to claim 16, further comprising a plurality of recesses in the base panel for containing display items.

22. The plastic holder according to claim 16, further comprising said plastic holder having sides, wherein said plastic holder is supported by a unitary V-shaped support, made of a resilient material selected from the group consisting of plastic, spring steel, aluminum, hard rubber and wood, having gripping means at each end of the support for attachment to the sides of the plastic holder, the gripping means adapted for slidable positioning at locations along the plastic holder, for varying a viewing angle of the plastic holder.

* * * * *